United States Patent [19]

Larsen

[11] 4,151,616

[45] May 1, 1979

[54] CAMPING SHOWER

[76] Inventor: Charles H. Larsen, 901 Date St., Rawlins, Wyo. 82301

[21] Appl. No.: 713,714

[22] Filed: Aug. 12, 1976

[51] Int. Cl.[2] ..... E03D 3/06; E03D 3/08; A41D 3/08

[52] U.S. Cl. ..... 4/145; 2/88; 4/151

[58] Field of Search ..... 4/145, 151, 154, 157, 4/160, 152, 153, 1; 135/5 B; 2/87-89

[56] References Cited

U.S. PATENT DOCUMENTS

| | | | |
|---|---|---|---|
| 785,233 | 3/1905 | Simpson, Jr. | 4/151 |
| 1,147,648 | 7/1915 | Rutland | 4/151 |
| 1,241,764 | 10/1917 | Pritchett | 4/151 |
| 1,330,312 | 2/1920 | Figueroa | 4/151 |
| 1,398,208 | 11/1921 | Trial | 4/151 |
| 1,599,798 | 9/1926 | Stockton | 135/5 B |
| 1,844,038 | 2/1932 | Hooker | 135/5 B X |
| 1,916,068 | 6/1933 | Nyhagen | 2/88 |
| 2,403,430 | 7/1946 | Andrews et al. | 4/151 |
| 2,757,384 | 8/1956 | Slater | 2/88 X |
| 3,077,609 | 2/1963 | Siline | 4/151 |
| 3,258,781 | 7/1966 | Klein | 2/88 |
| 3,307,201 | 3/1967 | Pearson | 2/87 |
| 3,391,409 | 7/1968 | Gatley | 4/154 |
| 3,958,274 | 5/1976 | Klauber | 2/89 X |

FOREIGN PATENT DOCUMENTS

| | | | |
|---|---|---|---|
| 1106361 | 7/1955 | France | 4/151 |
| 3204 of | 1914 | United Kingdom | 4/151 |
| 596687 | 1/1948 | United Kingdom | 4/151 |

*Primary Examiner*—Stuart S. Levy
*Attorney, Agent, or Firm*—John E. Reilly; James R. Young

[57] ABSTRACT

The present invention includes a novel and unique combination poncho or rain garment with means adapted for suspending the poncho from an overhead object in a manner whereby a portion of the waterproof fabric of the poncho forms a bag-like configuration for containing a quantity of water and a water dispensing means in the form of a shower head mounted in the poncho for allowing the water to be drawn from the reservoir in the bag configuration for use in washing and showering. The shower head is uniquely adapted for this purpose having an integral valve assembly which can be opened and allowed to close with the use of only one hand, as well as maintained in the full open position without the necessity of maintaining manual force on the valve operating mechanism.

11 Claims, 7 Drawing Figures

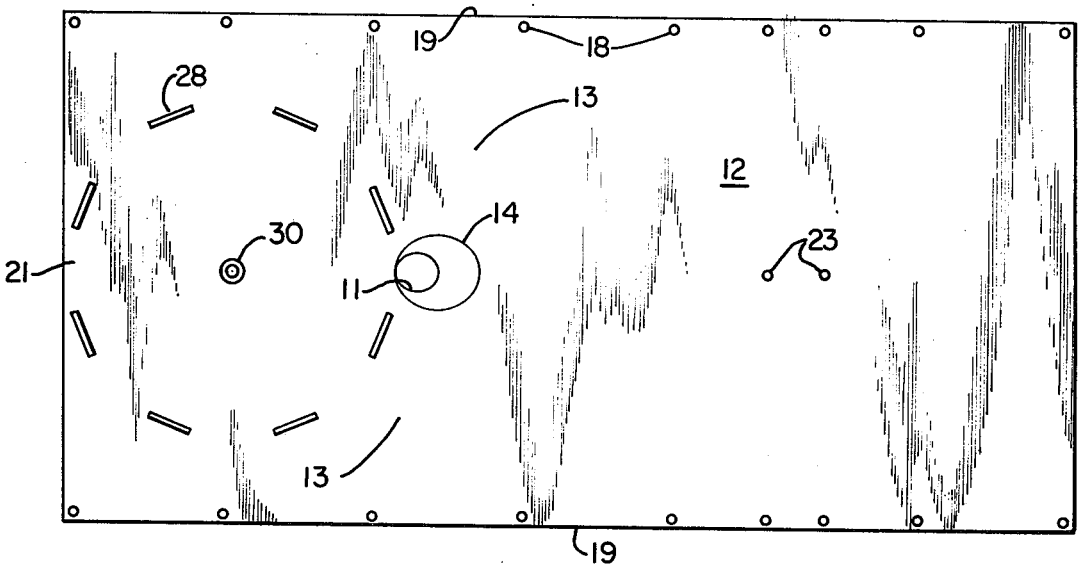
FIG. 3
FIG. 4
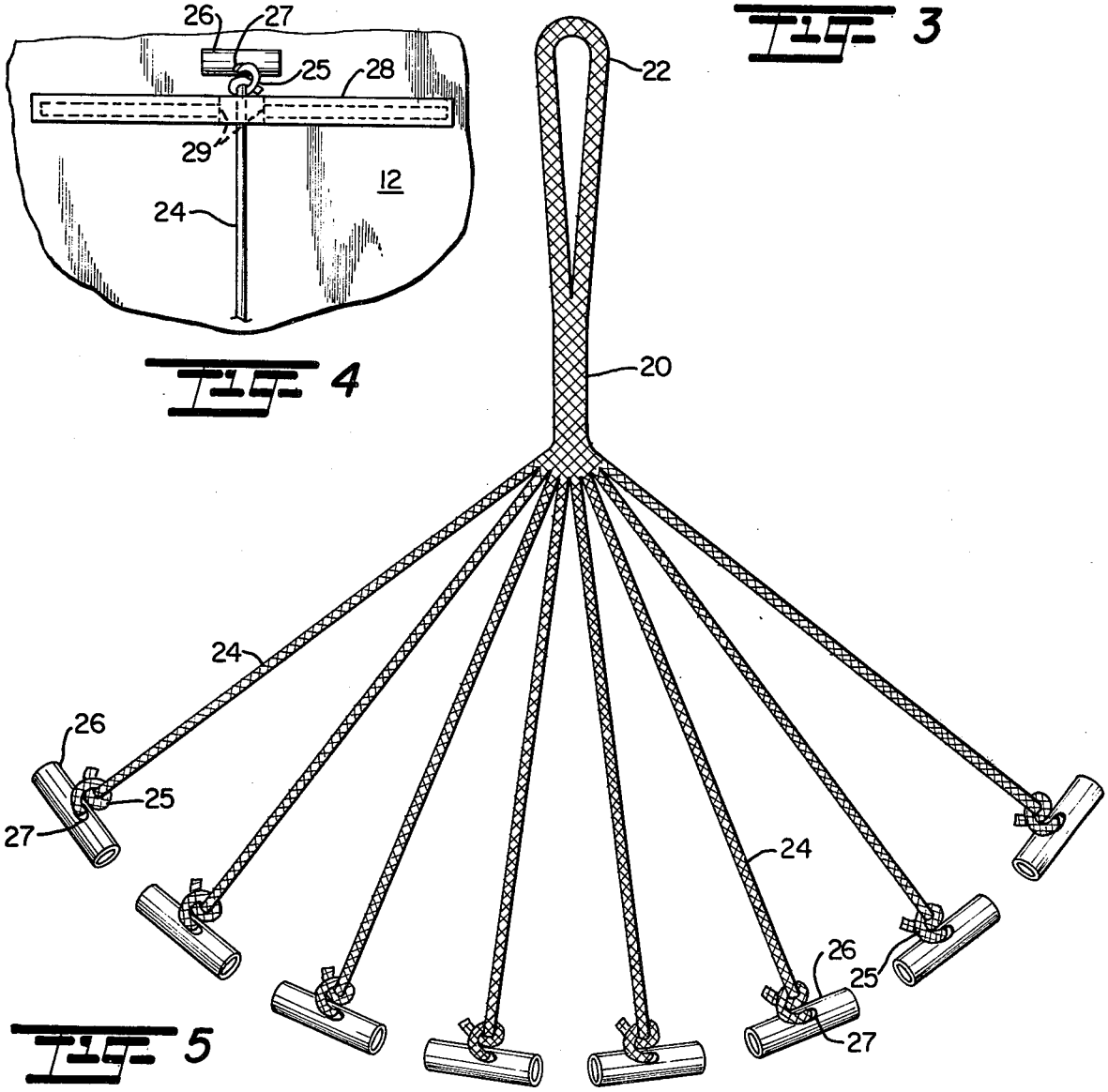
FIG. 5

CAMPING SHOWER

BACKGROUND OF THE INVENTION

The present invention relates generally to portable shower apparatus, and more particularly it relates to a portable camping shower with a manual cord operated valve in combination with a waterproof protective rain garment.

Campers, backpackers, soldiers and other persons who spend long perods of time away from civilization have long recognized the need for a portable shower facility which is preferably collapsible and easily packed with a minimum of space, such as, for carrying in a backpack or saddlebag. Numerous devices have been tried in the past with varying degrees of success. For example, the U.S. Pat. No. 1,241,764 issued to Pritchet, U.S. Pat. No. 1,398,208 issued to Trial, U.S. Pat. No. 1,844,038 issued to Hooker, U.S. Pat. No. 2,403,430 issued to Andrews et al, and U.S. Pat. No. 3,391,409 issued to Gatley, all disclose collapsible waterproof fabric reservoirs with hoops at the top and shower head attachments at the bottom. The U.S. Pat. No. 1,330,312 issued to Figueroa discloses a portable shower with a foldable shower curtain and shower head arrangement for packing in a hand bag that also serves as a water reservoir. Also, the U.S. Pat. No. 785,233 issued to Simpson, U.S. Pat. No. 1,147,648 issued to Rutland, and U.S. Pat. No. 1,330,312 issued to Figueroa all include shower valves of various construction which are operated by pulling suspended chains or cords.

While all of the above-cited patents disclose portable or collapsible shower apparatus which have been successful in various degrees in meeting the needs for showers away from civilization, the present invention provides improvements in several respects. As mentioned above, a primary concern of most persons who spend time away from civilization is to be able to carry along with them the essential equipment necessary to survival and for some minimum level of creature comfort while not requiring so much space or weight as to become inconvenient and unduly cumbersome. One item often included and considered necessary for survival and comfort by many such persons is a waterproof protective rain garment such as a full-length slipover poncho, sometimes including a hood. The present invention utilizes the waterproof fabric of such a protective rain garment for the alternate function of a water reservoir for a portable shower, thereby eliminating the necessity to carry an additional piece of equipment. The invention also includes an improved shower head which can be operated with a pull cord or chain that is more compact, reliable, and convenient to use than those disclosed in the prior art.

SUMMARY OF THE INVENTION

It is an object of the present invention to provide a new and improved portable shower apparatus for suspension from an overhead object.

It is another object of the present invention to provide an apparatus in combination with a waterproof protective garment for using the waterproof fabric of such a protective garment to function both as a portable shower and as protection from inclement weather.

It is yet another object of the present invention to provide a combination waterproof garment in the form of a poncho with a solid front cape portion which can be suspended from an overhead object for use as a water storage reservoir and water dispensing means for converting said front cape portion to a shower apparatus, the back of said poncho adapted to hang from said reservoir when suspended from an overhead object to function as a privacy curtain or wind break.

A further object of the present invention is to provide suspension means for use in combination with a waterproof garment for suspending said garment from an overhead object in such a way as to be capable of storing and dispensing water for use as a shower.

it is a still further object of the present invention to provide suspension means which is easily attachable to and detachable from the protective garment yet is strong and durable for supplying a sufficient quantity of water for a shower of reasonable duration.

Still another object of the present invention is to provide a new and improved shower head for a portable shower adaptable for use with a collapsible shower made of waterproof fabric.

A still further object of the present invention is to provide a compact, dependable shower head for use with a portable shower including a spring-loaded valve normally biased in closed position which can be opened with a pull cord or chain.

Yet another object of the present invention is to provide an improved shower head with a spring-loaded valve normally biased in a closed position with means for retaining said valve in an open position without the necessity of maintaining tension on the pull cord.

The present invention is directed to a novel and improved portable shower apparatus in combination with a waterproof garment which can be used in the field by campers, backpackers, soldiers and the like. The shower is comprised of a waterproof fabric with a plurality of detachable cords depending from loops for suspending said fabric from an overhead object in a bag-like configuration appropriate for containing a quantity of water sufficient to supply a shower of reasonable duration. A shower head with a spring-biased valve is also provided to conduct water from the side of the fabric forming the inside of the bag through the fabric to the opposite side where the water flows by gravity through shower nozzles. The vlave is in a normally closed position and is opened by pulling an attached cord or chain. Means are also provided to retain the valve in an open position if desired.

In the preferred form, the waterproof fabric used for the shower's bag-like reservoir is a portion of a waterproof raincoat, commonly referred to as a poncho. This combination provides an apparatus which serves the dual function of a protective garment in the rain and a portable shower when not being used as a protective garment. The resulting dual function apparatus has the advantage of providing the user with an article which serve both of the above-described functions while requiring him to carry essentially the equivalent of only one of those articles, thus reducing the size and weight of necessary equipment for camping, backpacking, and the like.

BRIEF DESCRIPTION OF THE DRAWINGS

Other objects, advantages and capabilities of the present invention will become more apparent as the description proceeds, taken in conjunction with the accompanying drawings, in which:

FIG. 3 is a plan view of the combination protective garment and portable shower apparatus;

FIG. 4 is an enlarged view of the suspension apparatus attachment means on a portion of the rain garment;

FIG. 5 is an elevational view of the suspension apparatus;

DETAILED DESCRIPTION OF THE PREFERRED EMBODIMENT

Figure 2:
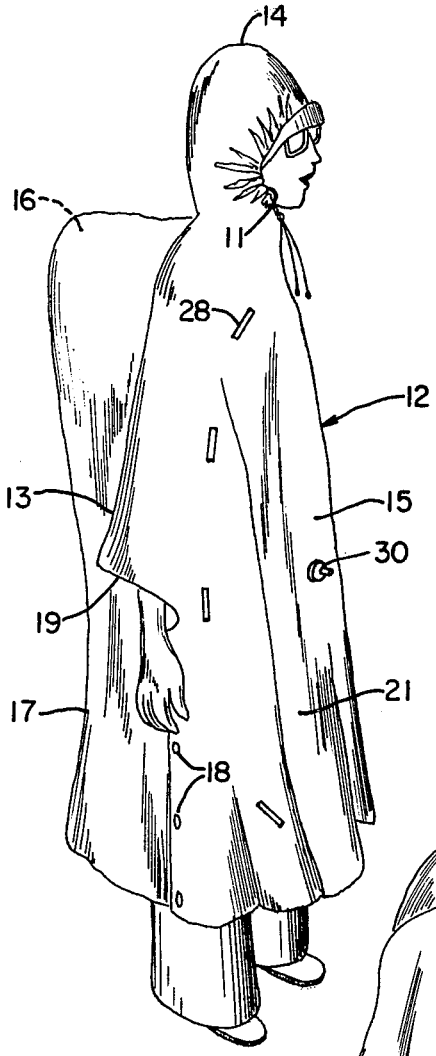
FIG. 2 is a perspective view of the portable shower apparatus in its dual function of being worn as a protective rain garment.
Figure 1:
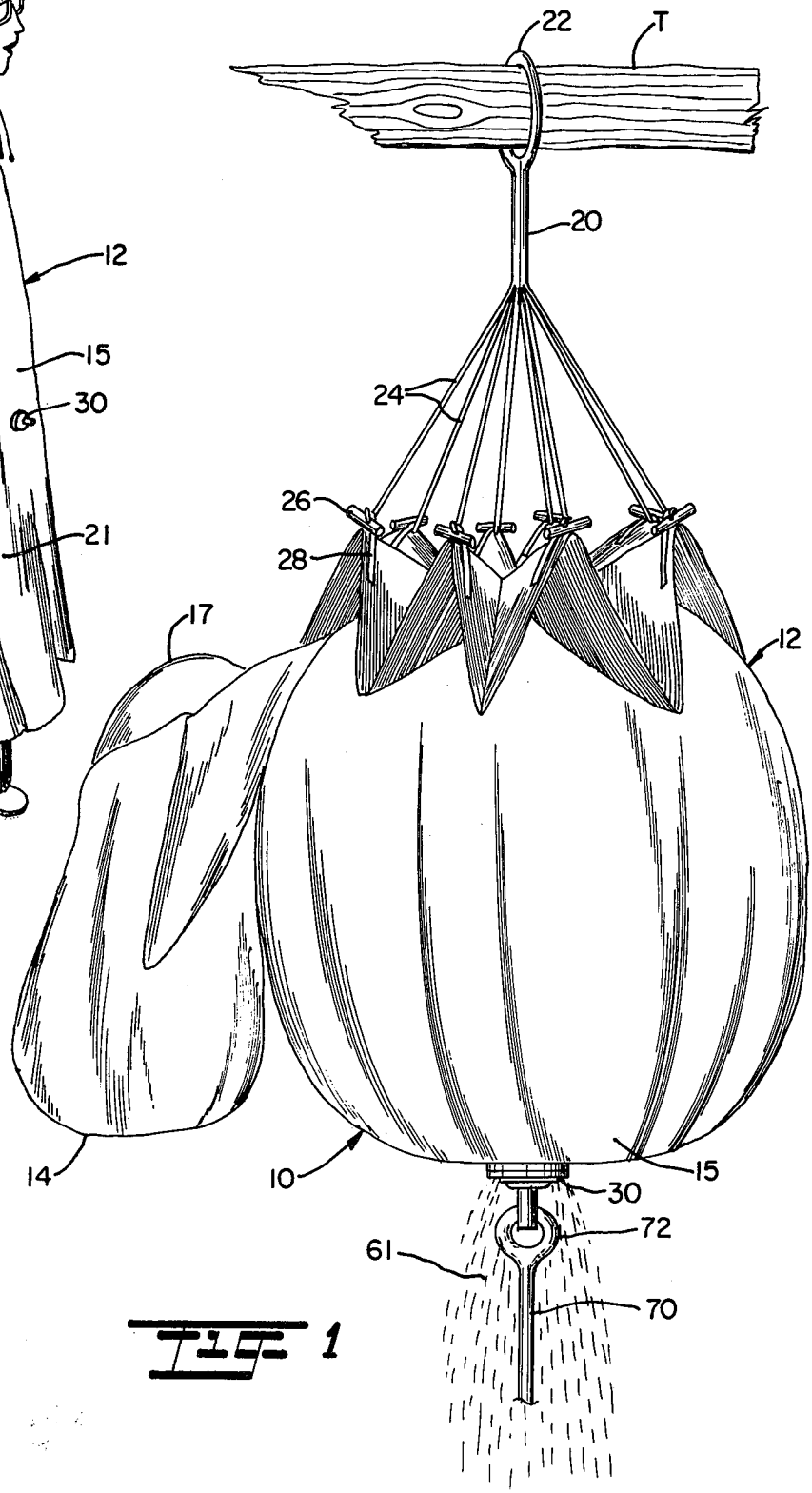
FIG. 1 is a side elevational view of the portable shower apparatus filled with water and suspended from an overhead object.

A portable shower apparatus 10 in accordance with the present invention is illustrated in FIG. 1 full of water and suspended from an overhead object such as the branch of a tree T. FIG. 2 illustrates the preferred embodiment of the invention being worn as a water-resistant protective garment or poncho 12. The garment 12 has an opening 11 for the head, a hood 14, a coat or body covering 15 and an extra length of fabric on the back 17 to cover a backpack 16. Expandable snap-fasteners 18 are provided along the sides of the garment to fasten the front and rear portions together while the garment is being worn, said snap-fasteners being positioned to fasten the fabric in such a manner as to allow arm openings 19 in sleeve portions 13 of the fabric extend from over the shoulders. Additional snap-fasteners 23 are also provided on the excess back portion 17 to retain the excess fabric in a partially rolled-up position when the poncho is being worn, but not with a backpack.

Essentially, the preferred embodiment of the present invention utilizes a portion of the waterproof fabric of a protective garment 12 for the alternative application as a water container or reservoir of a portable shower. The suspension cord 20 with a loop 22 at one end and a plurality of strands 24 depending from the other end is provided to hold the waterproof fabric 12 in a suspended position for use as a shower reservoir. The suspension cord 20 is removably attached to the coat 15 so that the cord 20 can be detached from the coat when it is desired to use the garment as a poncho 12, as shown in FIG. 2.

The attachment means is comprised of a plurality of straps 28 permanently affixed to the fabric of the garment 12 in a substantially circular pattern on the front portion 21 of the poncho. The strap 28 is attached to the fabric of the garment 12 at both ends leaving a narrow gap or loop 29 near the center of the strap 28 which is not attached to the fabric 12. At the free end of each depending strand 24, a segment of elongated tube 26 is fastened at midspan to the strand 24, such as by threading the end of the strand 24 through a transverse hole 27 in the midspan of the tube 26 and securing it in a knot 25. Thus it can be appreciated that a tube 26 can be passed longitudinally through the gap 29 in strap 28 drawing the knot 25 and the end of strand 24 through the gap 29 also, and when entirely through the gap 29, the tube 26 can be turned transverse to the gap 29 in which position its length dimension is too great to pass transversely back through the gap 29 whereby the strand 24 will be retained in this attached position to the fabric 12 by the permanently fastened portion of the strap 28. When all of the depending strands 24 are attached to the waterproof garment 12 in this manner to form a water container for a shower reservoir as shown in FIG. 1, the reservoir can be filled with water and suspended to an overhead object for use as a shower.

Also as shown in FIG. 1, the excess fabric 17 of the protective garment 12 which is not utilized directly as a water reservoir for the shower can be folded and conveniently stuffed into the hood 14 as shown in FIG. 1, or it can be allowed to drape downward alongside the shower to serve as a privacy curtain or wind screen.

A combination shower head and valve 30 is permanently attached to the waterproof fabric 12 at the approximate center of the circular pattern formed by the steps 28, as seen in FIGS. 1, 2, and 3. The combination shower head and valve 30 provides a closable conduit through which water can pass from the reservoir through the fabric 12 in gravity flow as a shower onto a user standing under the shower head 30.

Figure 6:
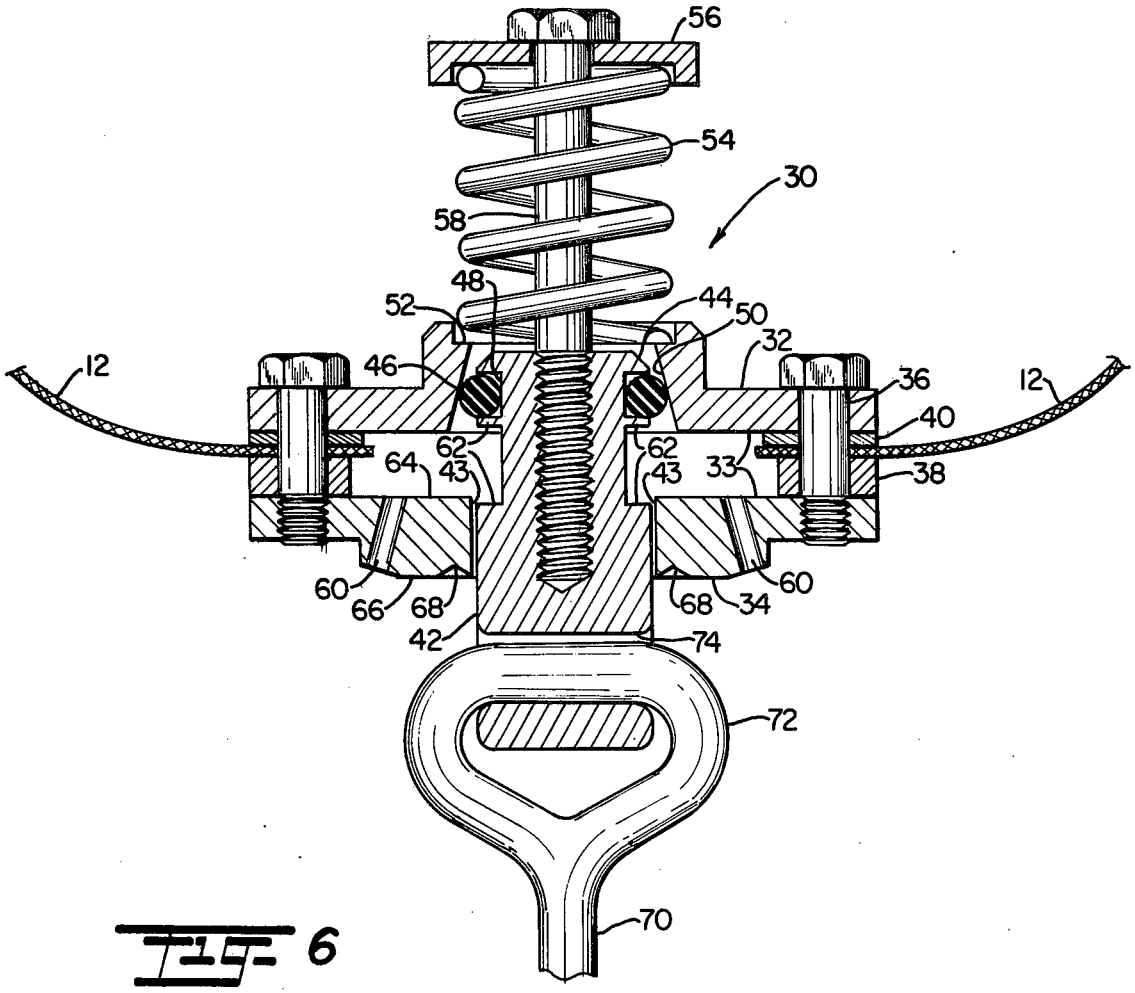
FIG. 6 is an enlarged cross-sectional view in elevation of the shower head apparatus.
Figure 7:
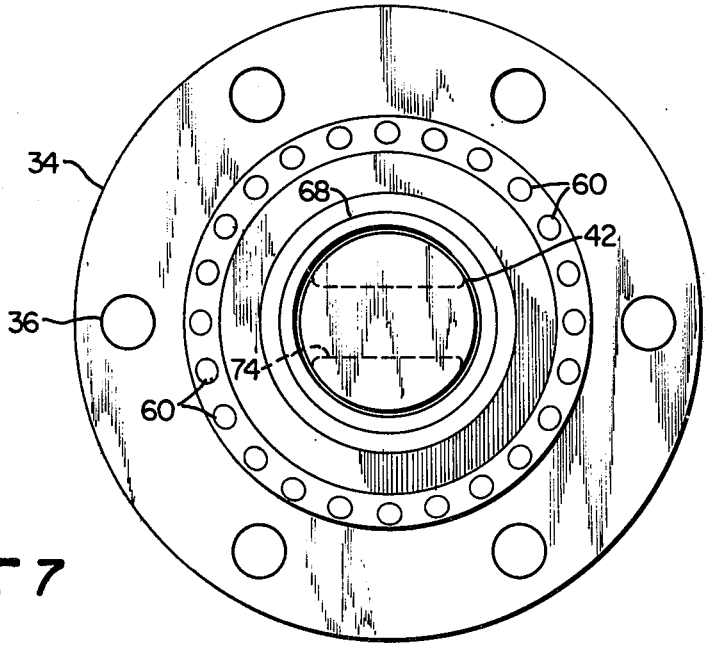
FIG. 7 is a bottom plan view of the shower head apparatus.

The unique structural configuration of the shower head 30 is best seen in FIGS. 6 and 7. It is formed of an upper body portion 32 and a lower body portion 34 fastened together by bolts 36 which are threadedly received into the lower body portion 34. A spacer ring 38 is provided to maintain the upper body portion 32 and the lower body portion 34 a spaced distance apart in relation to one another to form a water distribution chamber 33 therebetween. The shower head 30 is attached to the waterproof fabric 12 by sandwiching the fabric 12 between the spacer ring 38 and the upper body portion 32. A gasket 40, preferably of rubber or other similar water-proof material, is also provided between the fabric 12 and the upper body portion 32 to effect water tightness.

A valve is provided at the center of the shower head 30 to regulate the flow of water from the reservoir through the shower head. The valve is comprised of a valve stem 42 oriented for vertical travel in relation to the valve guide 43. On the top end of the valve stem 42 is a beveled valve face 44 and immediately below the valve face 44 is a circumferential groove 48 around the entire valve stem which retains an O-ring seal 46 surrounding the circumference of the valve stem 42.

A beveled valve seat 50 is defined on the side of the water conduit in the upper body portion 32. When the valve stem 42 is urged upwardly causing the O-ring seal 46 to contact the valve seat 50, water is effectively prohibited from flowing out of the reservoir 12. However, when the valve stem 42 is moved downward carrying the O-ring seal 46 away from contact with the valve seat 50, water is allowed to flow from the reservoir through the upper body portion 32 and into the distribution chamber 33. From the distribution chamber 33, the water flows through a plurality of shower nozzles 60 defined by holes through the lower body portion 34. Of course, from the shower nozzle 60, the water free-falls in the form of a shower onto the user below as indicated at 61 on FIG. 1.

The shower head valve in this invention is also provided with a spring 54 mounted under compression urging the valve stem 42 to a normally closed position. The spring 54 is positioned in a spring seat 52 defined around the conduit in the upper body portion 32 just over the valve seat 50. The spring 54 is retained in a compressed state by a keeper 56 which is maintained in a spaced relation to the top of the valve stem 42 by a keeper bolt 58 which is threadedly received into the valve stem 42. It can be appreciated that the spring 54 in its compressed state reacts at the lower end against the spring seat 52 in the upper body portion 32 and at the other end against the keeper 56 which tends to urge the valve stem 42 with the O-ring seal 46 into sealing contact with the valve seat 50 in the upper body portion 32. It is also obvious that a tension force pulling on the lower end of the valve stem 42 sufficient to overcome the force of the spring 54 will cause the valve stem 42 and the O-ring seal 46 to move downwardly in relation to the valve guide 43 and the valve seat 50 allowing water to flow from the reservoir through the shower head as described above. Release of such a tensile force on the valve stem 42 would, of course, allow the valve stem 42 to return to its closed position.

For the convenience of a person using the shower, a valve cord 70 is provided with a loop 72 threaded through a hole 74 in the valve stem 42. Thus, a person using the shower can conveniently open the valve by pulling on the valve cord 70 to start the shower, and he can shut off the shower by simply releasing his pull on the valve cord 70. Of course, the rate of water flowing through the valve can be regulated by the amount of force applied to the valve cord 70 which varies the effective distance between the O-ring seal 46 and the valve face 50 resulting in larger or smaller area through which water can flow and thereby effecting the rate of flow.

The user may also desire to open the valve and to have the valve remain open without the user having to maintain the tensile force on the valve cord 70, such as while he is soaping and washing with both hands. To accommodate the user in this fashion, a circular channel 62 is provided around the entire circumference of the valve stem 42 immediately below the O-ring seal 46 and corresponding circumferential groove 48. The width of channel 62 is sufficient to span the thickness of the valve guide 43 and deep enough so that the valve guide 43 between the internal face 64 and the external face 56 of the lower body portion 34 can be inserted therein. Consequently, when the valve stem is pulled open a distance far enough to align the internal face 64 and external face 66 of the lower body portion with the channel 62, a slight lateral force on the valve stem will cause the valve guide 43 to be inserted into the channel 62. Then when the pulling force on the valve cord 70 is released, the lower face of channel 62 will bindingly engage the lower face 66 whereby the valve stem 42 will be prevented from returning to the closed position. A circular groove in the external face 66 defines a notch 68 which assists in maintaining the valve stem 42 in the above-described cocked open position. A simple pull on the valve cord 70 sufficient to overcome the force of spring 54 and directed slightly toward the center of the valve will cause the channel 62 to become disengaged from the valve guide 43 thereby allowing the valve to close again when the tensile force on the valve cord 70 is released.

It can therefore be appreciated that this novel invention is fully capable of serving dual functions as a protective rain garment during times of inclement weather and a portable shower at other times, thereby giving the user the convenience of both the protective garment and the shower while requiring him to bear the burden of carrying essentially one item. It can also be appreciated that the unique combination valve and shower head provided in this invention for the portable shower enables one to conveniently control the flow of water at any desired rate from no flow to maximum flow including sustained flow in the full flow position by the simple pulling manipulation of a valve cord.

Although the present invention has been described with a certain degree of particularity, it is understood that the present disclosure has been made by way of example and that changes in details of structure may be made without departing from the spirit thereof.

What is claimed is:

1. A rain protective camping shower and garment fabricated of water-resistant fabric, the combination comprising:

a substantially solid blanket-like garment comprised of a front portion adapted for covering the front portion of a persons body and a back portion adapted for covering the back portion of a persons body and including a camping shower formed in said blanket;

attachment means affixed in a substantially symmetrical pattern to a portion of said garment, said garment having a head opening at the juncture of the front and back portions and adapted to admit the head of a wearer and means on opposite sides of said head opening adapted to allow the arms of the wearer to protrude to the outside, said attachment means adapted to facilitate suspension of said garment from an overhead object in a configuration forming a reservoir to contain water for a shower; and water dispensing means attached to said garment at the approximate center of said symmetrical pattern of attachment means, said water dispensing means including a conduit for the passage of water from one side of said fabric to the opposite side.

2. The combination of claim 1, wherein said garment is in the form of a poncho, fasterners along the respective sides of said blanket for releasably fastening the lower side extremities of said front and back portions respectively together, and wherein said attachment means includes a plurality of individual loops affixed in spacedapart relation to adjacent loops in a circular pattern on said front portion of said garment.

3. The combination of claim 2, including suspension means for hanging said garment from an overhead object said suspension means adapted for releasable attachment to said attachment means.

4. The combination of claim 3, wherein said suspension means includes a rope portion and a plurality of separate strands depending from said rope portion with connection means at the end of each strand for mating detachable connection with said attachment means on said fabric.

5. The combination of claim 4, wherein said connection means includes an elongated tube fastened at mid-span to said strand, said tube being capable of passing axially completely through said loop along with a portion of said strand and then retained therein by twisting said rod so that said loop bears simultaneously on said strand and on the lateral undersurface of said rod.

6. The combination of claim 4, wherein said rope portion includes a loop at its upper end to accommodate attachment to an overhead object.

7. The combination of claim 1, wherein said water dispensing means includes a shower head with an integral spring-loaded valve normally biased in closed position, said attachment means and said shower head being positioned on said garment so that said shower head projects externally of said reservoir when said reservoir is filled with water.

8. The combination of claim 7, including means for retaining said valve in an open position.

9. The combination of claim 7, wherein a flexible cord depends from said valve for manually opening said valve from a position under said garment.

10. The combination of claim 2, wherein said back portion comprises a privacy curtain depending from said reservoir when suspended from an overhead object for use as a shower.

11. The combination of claim 1, including a reservoir comprised of a substantially symmetrically shaped waterproof fabric, the perimeter of said fabric forming the rim of said rservoir;

suspension means detachably connected to said reservoir for suspending said reservoir from an overhead object, said suspension means including a flexible cord with a plurality of depending strands, the end of each strand having an elongated retainer member connected at its midsection thereto, and a plurality of loops permanently affixed to said rim of said reservoir in spaced relation to one another, whereby a retainer member is capable of passing longitudinally through said loop with the end of a strand, but said retainer member is not capable of passing through said loop when turned transversely to said loop thus detachably connecting said suspension means to said reservoir; and wherein said water dispensing means includes a shower head attached to said reservoir, including a valve for regulating the flow of water from said reservoir through said shower head.

* * * * *

UNITED STATES PATENT OFFICE

CERTIFICATE OF CORRECTION

Patent No. 4,151,616 Dated May 1, 1979

Inventor(s) Charles H. Larsen

It is certified that error appears in the above-identified patent and that said Letters Patent are hereby corrected as shown below:

Column 1, line 18, cancel "Pritchet" and substitute -- Pritchett --.
Column 1, line 39, cancel "to" and substitute -- for --.
Column 2, line 11, cancel "it" and substitute -- It --.
Column 2, line 43, cancel "vlave" and substitute -- valve --.
Column 2, line 55, cancel "serve" and substitute -- serves --.
Column 3, lines 25 and 26, cancel "snap-fastners" and substitute -- snap-fasteners --.
Column 3, line 30, after "fabric" add -- which --.
Column 4, line 14, cancel "steps" and substitute -- straps --.

UNITED STATES PATENT OFFICE

CERTIFICATE OF CORRECTION

Patent No. 4,151,616 Dated May 1, 1979

Inventor(s) Charles H. Larsen

It is certified that error appears in the above-identified patent and that said Letters Patent are hereby corrected as shown below:

Claim 2, Column 6, line 40, cancel "spacedapart" and substitute -- spaced-apart --.

Claim 11, Column 7, line 13, cancel "rservoir" and substitute -- reservoir --.

Signed and Sealed this

*Fourth* Day of *December 1979*

[SEAL]

*Attest:*

SIDNEY A. DIAMOND

*Attesting Officer*

*Commissioner of Patents and Trademarks*